United States Patent [19]

Askey et al.

[11] Patent Number: 4,860,567

[45] Date of Patent: Aug. 29, 1989

[54] RING FORGING PROCESS

[75] Inventors: William G. Askey, Jupiter; Steven M. Hopkins, North Palm Beach, both of Fla.

[73] Assignee: United Technologies Corporation, Hartford, Conn.

[21] Appl. No.: 135,768

[22] Filed: Dec. 21, 1987

[51] Int. Cl.[4] ..... B21C 23/20; B21C 29/00

[52] U.S. Cl. ..... 72/254; 72/256; 72/267; 72/352

[58] Field of Search ..... 72/70, 254, 256, 264, 72/267, 338, 352, 353, 358, 342; 29/156.62

[56] References Cited

U.S. PATENT DOCUMENTS

| | | | |
|---|---|---|---|
| 1,216,282 | 2/1917 | Carver et al. | 72/267 |
| 3,519,503 | 7/1970 | Moore et al. | 148/11.5 F |
| 3,529,503 | 9/1970 | Sederberg | 83/146 |
| 3,698,219 | 10/1972 | Moore et al. | 72/38 |
| 3,780,553 | 12/1973 | Athey | 72/41 |
| 4,073,174 | 2/1978 | Moore | 72/267 |
| 4,265,105 | 5/1981 | MacNitt, Jr. et al. | 72/354 |
| 4,312,211 | 1/1982 | MacNitt, Jr. et al. | 72/354 |

FOREIGN PATENT DOCUMENTS

| | | | |
|---|---|---|---|
| 141345 | 11/1980 | Japan | 72/352 |
| 120341 | 7/1984 | Japan | 72/70 |

OTHER PUBLICATIONS

Definitions of Metallurgical Terms by ASM Committee on Definition of Metallurgical Terms, Copyright 1977.

*Primary Examiner*—Lowell A. Larson

*Attorney, Agent, or Firm*—Charles E. Sohl

[57] ABSTRACT

A process is described for producing forged ring articles from high strength, high temperature materials such as superalloys and titanium alloys. The material to be forged is conditioned and placed into a condition of low strength and high ductility. This starting material is then back extruded to produce a cup. The cup can be sliced into rings in which can thereafter be final forged to a particular contour.

1 Claim, 1 Drawing Sheet

RING FORGING PROCESS

DESCRIPTION

1. Technical Field

This invention relates to the forging or rings from superalloys and titanium alloys.

2. Background Art

This invention was developed in the gas turbine engine field and has particular application in this field but is not so limited.

Gas turbine engines include rotating assemblies mounted within stationary assemblies. Both rotating and stationary assemblies have many components with axisymmetric geometries. Many of these components can be described as ring shaped.

Because of the nature of gas turbine engines and their operation at high temperature and high stresses, most components must be formed from forged high temperature alloys such as nickel base superalloys or titanium. Large ring structures are conventionally formed by rolling. Smaller ring structures, however are commonly formed by first producing a flat forged preform "pancake" and then further forging this flat pancake preform into a circular article having a raised rim portion and a relatively flat internal web portion which is removed by machining. This prior art process is not entirely an advantageous one since it produces a substantial amount of scrap in the internal portion, and because of the high projected area the necessary forging forces are high requiring a large press and contributing to die wear.

U.S. Pat. Nos. 3,529,503; 3,698,219; 3,780,553; 4,265,105; and 4,312,211 relate to the forging of superalloys and titanium under conditions of low strength and high ductility and are incorporated herein by reference.

Accordingly, it is an object of the present invention to form superalloy and titanium alloy rings at a lower forging pressure than that used by the prior art. It is another object of the invention to reduce the amount of scrap involved in production of such forged rings.

These and other objects and advantages of the present invention will be made clear through reference to the following description of preferred embodiments, figures and claims.

DISCLOSURE OF THE INVENTION

The invention comprises a method for efficiently and economically producing forged superalloy rings. According to the invention the superalloy starting material is placed in a condition of low strength and high ductility and is then forged using a punch and die arrangement. The die is substantially smaller than the punch diameter and upon movement of the punch into the die the workpiece flows into the annulus between the punch and die forming a hollow shaped article. The article is then sliced into ring shaped sections which can then be further processed to a final configuration.

The foregoing and other features and advantages of the present invention will become more apparent from the following description and accompanying drawings.

BEST MODE FOR CARRYING OUT THE INVENTION

The invention process is best understood through consideration of FIGS. 1 through 4 which illustrate the conversion of the starting billet into a plurality of finished ring structures.

Billets of superalloys and titanium alloy materials can be processed according to the teachings of U.S. Pat. No. 3,519,503 to place them into a temporary condition of low strength and high ductility. More specifically, such alloys can be conditioned by extrusion of a starting billet to produce an area reduction of at least about 4 to 1 at a temperature which is below but within about 450° F. of the normal alloy recrystallization temperature. The resultant material will have a recrystallized grain structure with an average grain size which does not exceed about 35 microns.

This preconditioning step is critical to the success of the present invention. Table 1 lists a variety of commonly employed superalloy and titanium compositions. Table 2 lists the normal recrystallization temperature for these material.

Figure 1:
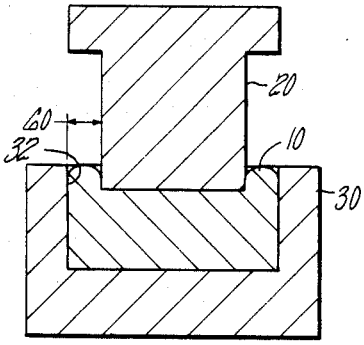
FIG. 1 shows the initial portion of the forging operation.

In what follows it will be assumed that the starting material has been processed to condition of low strength and high ductility as discussed above. FIG. 1 shows the starting billet 10 in a punch 20 and die 30 assembly after the start of the forging operation. The assembly is characterized by the punch 20 having a diameter which is substantially less than that of the die cavity 32 so that when the punch and die are arranged on the common centerline a uniform annulus will exist when the punch 20 is placed within the die cavity 32.

Figure 2:
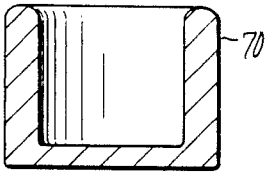
FIG. 2 shows the cup shaped intermediate article.

As shown in FIG. 1, when the starting billet 10 is placed within the die cavity 32 and the punch 20 forced into the starting material 10, the material will flow upwards into the annulus 60 defined by the punch 20 and die cavity 32 forming an intermediate product 70 with a cylindrical cross section. FIG. 2 shows the result of this process which comprises a cup like article 70 whose wall geometry is essentially that of the annulus between the punch 20 and die cavity 32 and whose bottom thickness is determined by the final distance between the punch face and the die bottom.

In typical experimental work to date and the diameter of the cup structure has been about 6 inches and the wall thickness has been on the order of 1 inch. The height of the cylinder is limited by friction between the workpiece and the punch and die assembly, but the height of the cylinder in that develop on a work to date has been at least equal to its diameter.

All previously described forging work has been done at a temperature below but within about 350° F. of the normal recrystallization temperature of the material. Operation within this temperature range is necessary in order that the material exhibit the low strength and ductility properties. Vacuum or inert atmosphere is necessary to prevent punch, die and workpiece oxidation.

Figure 3:
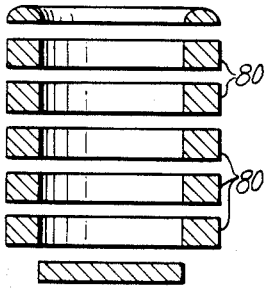
FIG. 3 shows the cup sliced into rings.
Figure 4:
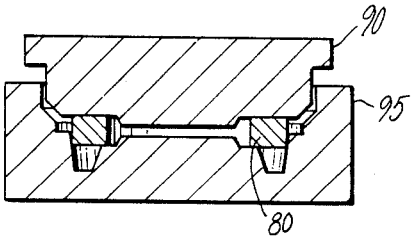
FIG. 4 shows the rings being forged into final shape.

The cup shaped intermediate product shown in FIG. 2 is then sliced into a plurality of ring shaped preforms 60 as shown in FIG. 3. The slicing may be done by mechanical means such as sawing or abrasive cut off wheel or by other more advanced methods such as EDM. The resultant rings 80 are then forged into the desired final contour in a die assembly 90, 100 similar to that used in the prior art except that because the preforms used in the die assembly do not have a solid center, the preforms can be forged at a substantially lower total pressure. This is illustrated in FIG. 4. Again, the forging operation is performed at temperature below but within 350° F. of the normal recrystallization temperature of the material in order that the forging be done under conditions at which the material displays low strength and high ductility.

In some situations machining to a final contour may be the most effective approach. Subsequent to this final step the resultant rings can then be processed conventionally by machining to exact dimensions, heat treating, coating, etc., all of which are conventional operations and not part of the present invention.

The materials for which the present invention is intended to be applied are so strong even at elevated temperatures and conditions of low strength and high ductility that they must be processed in using special dies preferably made of TZM molybdenum alloy. Use of molybdenum base alloy dies requires that the process be performed under conditions of high vacuum, protective or inert atmosphere in order to prevent die oxidation. Likewise, because of the high processing temperatures and pressures, it is necessary to provide a lubricant between the die and the workpiece in order to prevent galling, sticking and binding of the workpiece to the die material, such lubricant may advantageously be molybdenum disulfide based and may be applied as described in U.S. Pat. No. 3,780,553 which is incorporated herein by reference. The strain rate of all working operations should be monitored and controlled and should be in the range of 0.1—1.0 inches per inch per minute.

As an alternative to the previously described method for preconditioning material by extrusion, starting material in its temporary condition of low strength and high ductility may also be obtained by the hot isostatic compaction of fine powder under conditions which inhibit grain growth. To achieve the requisite low strength high ductility properties to starting powders size must be on the order of the 35 micron grain size previously mentioned for extruded material, this corresponds to a powder size of about −270 mesh (U.S.) and finer. Powder of this size and the desired composition can be hot isostatically pressed at for example 15 ksi at a temperature below its recrystallization or gamma prime solvus temperature and the resultant product will be suitable for use in the present invention process.

Starting material can also be produced by extrusion of coarse powder to produce the fine grain size as a result of the extrusion process. Extrusion may also be used in conjunction with cast starting material as described for example in U.S. Pat. Nos. 4,574,015 and 4,579,602.

Although this invention has been shown and described with respect to detailed embodiments thereof, it will be understood by those skilled in the art that various changes in form and detail thereof may be made without departing from the spirit and scope of the claimed invention.

TABLE 1

| | |
|---|---|
| IN100 | 10% Cr, 15% Co, 4.5% Ti, 5.5% Al, 3% Mo, 0.17% C, 0.75% V, 0.015% B, 0.05% Zr, Bal Ni. |
| Waspaloy | 19.5% Cr, 13.5% Co. 0.07% C, 3.5% Ti, 1.4% Al, 4% Mo, 0.005% B, 0.08% Zr, Bal N. |
| Astroloy | 15.5% Cr, 17% Co, 0.07% C, 3.5% Ti, 4.0% Al, 5.0% Mo, 0.025% B, Bal Ni. |
| Ti 8-1-1 | 7.9% Al, 1.0% Mo, 1.0% V, Bal Ti. |
| Ti 6-4 | 6.0% Al, 4.0% V |

TABLE 2

| | Recrystallization Temperature, °F. |
|---|---|
| IN100 | 2100 |
| Waspaloy | 1850 |
| Astroloy | 2050 |
| Ti 8-1-1 | 1600 |
| Ti 604 | 1400 |

We claim:

1. Method for producing rings from superalloys and titanium alloys including the steps of a. forging starting materials in a condition of low strength and high ductility, in a punch and die assembly wherein an annulus exists between the punch and die to form a cup shaped intermediate article;

b. slicing the cup into rings.

c. forging said rings, under conditions of low strength and high ductility, to produce a final desired cross-section.

* * * * *